US007017289B2

(12) United States Patent
Destefanis

(10) Patent No.: US 7,017,289 B2
(45) Date of Patent: Mar. 28, 2006

(54) EARTH-MOVING VEHICLE WITH DEVICE FOR CONFIGURATION OF PROFILE FOR CIRCULATION ON ROAD

(75) Inventor: Luca Destefanis, Turin (IT)

(73) Assignee: CNH America LLC, New Holland, PA (US)

( * ) Notice: Subject to any disclaimer, the term of this patent is extended or adjusted under 35 U.S.C. 154(b) by 103 days.

(21) Appl. No.: 10/738,821

(22) Filed: Dec. 17, 2003

(65) Prior Publication Data

US 2004/0194981 A1 Oct. 7, 2004

(30) Foreign Application Priority Data

Dec. 20, 2002 (IT) ..... TO2002A1105

(51) Int. Cl.
*E02F 5/02* (2006.01)

(52) U.S. Cl. ..... 37/348

(58) Field of Classification Search ..... 37/348, 37/382, 443; 414/699, 694; 172/2, 5, 6, 172/9; 701/50
See application file for complete search history.

(56) References Cited

U.S. PATENT DOCUMENTS 4,600,356 A * 7/1986 Bridges et al. ..... 414/694
5,000,650 A * 3/1991 Brewer et al. ..... 414/699
5,188,502 A * 2/1993 Tonsor et al. ..... 414/700
5,704,141 A * 1/1998 Miura et al. ..... 37/348
5,822,891 A * 10/1998 Fujishima et al. ..... 37/348
5,924,516 A * 7/1999 Sagaser et al. ..... 180/333
6,226,902 B1 * 5/2001 Heyne ..... 37/348
6,233,511 B1 * 5/2001 Berger et al. ..... 701/50
6,729,050 B1 * 5/2004 Whitten et al. ..... 37/96

* cited by examiner

*Primary Examiner*—Victor Batson
(74) *Attorney, Agent, or Firm*—J. William Stader; Stephen A. Bucchianeri

(57) ABSTRACT

An earth-moving vehicle includes a mobile operating arm; at least one actuator for moving the operating arm through a plurality of positions, wherein one of the plurality of positions is a pre-defined reference position; a control for actuating the actuator; and a configuration device. The configuration device includes a sensor designed for detecting at least the pre-defined reference position of the operating arm and for issuing a corresponding position signal, a disabling valve activated automatically according to the position signal to disable actuation of the actuator when the operating arm reaches the predetermined reference position, and a re-enabling switch which can be switched manually by an operator for deactivating the disabling means to enable the actuator to be actuated.

10 Claims, 2 Drawing Sheets

EARTH-MOVING VEHICLE WITH DEVICE FOR CONFIGURATION OF PROFILE FOR CIRCULATION ON ROAD

BACKGROUND OF THE INVENTION

1. Field of the Invention

The present invention relates to an earth-moving vehicle provided with a chassis, with an operating arm that is mobile with respect to the chassis, and with a device for configuring the profile of the vehicle by setting the operating arm in a pre-determined reference position such as to enable circulation of the vehicle on the road.

2. Description of the Background of the Invention

As is known, the operating arm of earth-moving vehicles is of an articulated type, is actuated by a plurality of hydraulic cylinders, and must be configured in a pre-determined reference position when the vehicle circulates on the road, so as to respect the parameters of maximum encumbrance laid down in the highway code (for example, in Germany, the maximum height from the ground of the vehicle must be less than 4 meters (13 feet), whilst in the longitudinal direction of advance of the vehicle the distance of the operating arm from the steering column must be less than 3.5 meters (11.5 feet)).

In order to position the operating arm in such a way as to satisfy these parameters, the driver must actuate the manual controls present in the cab for bringing the rods of the cylinders into a pre-set end-of-travel position, except for one of these cylinders, the rod of which must be set in a pre-defined intermediate position. This cylinder is normally the one that moves the last stretch of the operating arm, i.e., the one that carries the earth-moving member at its end.

In order to position the rod of this cylinder in the pre-defined intermediate position, the driver must visually control the relative displacement of the various portions of the operating arm, but this operating modality is, on the one hand, somewhat inconvenient for the driver who has to maneuver the controls within the cab of the vehicle and, on the other, relatively imprecise, precisely because it depends totally upon the sensitivity of the driver himself.

There is thus felt the need to provide an earth-moving vehicle equipped with a device for configuration of the profile for circulation on the road, which will enable a precise positioning to be obtained irrespective of the sensitivity of the driver and of possible subsequent accidental maneuvers made by the driver himself on the controls present in the cab.

The purpose of the present invention is to provide an earth-moving vehicle equipped with a device for configuration of the profile for circulation on the road, which will enable the need outlined above to be met in a simple and economically advantageous way.

SUMMARY OF THE INVENTION

According to an aspect of the present invention, an earth-moving vehicle includes a mobile operating arm; at least one actuator for moving the operating arm through a plurality of positions, wherein one of the plurality of positions is a pre-defined reference position; a control for actuating the actuator; and a configuration device. The configuration device includes a sensor designed for detecting at least the pre-defined reference position of the operating arm and for issuing a corresponding position signal, a disabling valve activated automatically according to the position signal to disable actuation of the actuator when the operating arm reaches the predetermined reference position, and a re-enabling switch which can be switched manually by an operator for deactivating the disabling means to enable the actuator to be actuated.

The invention will now be described with reference to the annexed drawings, which illustrate a non-limiting example of an embodiment thereof.

DETAILED DESCRIPTION OF THE PREFERRED EMBODIMENTS

Figure 1:
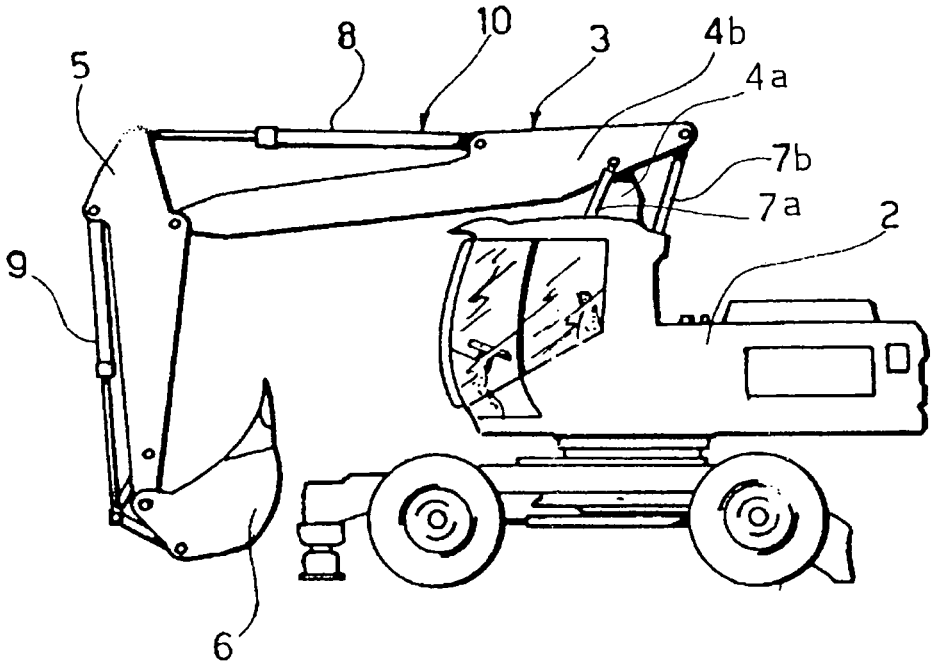
FIG. 1 illustrates, in side elevation, a preferred embodiment of the earth-moving vehicle provided with a device for configuration of the profile for circulation on the road, according to the present invention.

In FIG. 1, the reference number 1 designates an earth-moving vehicle, in particular an excavating vehicle, comprising a chassis 2 and an operating arm 3, which is made up of a stretch 4*a* hinged to the chassis 2, a terminal stretch 5, which carries at its end an operating member 6 for earth moving, and an intermediate stretch 4*b*, hinged to the stretches 4*a* and 5.

The member 6 and the stretches 4*a*, 4*b* and 5 are rotated with respect to one another and with respect to the chassis 2 by means of a plurality of hydraulic cylinders, designated by the reference numbers 7*a*, 7*b*, 8, 9, which form part of a hydraulic circuit 10 of a known type. The circuit 10 is illustrated schematically in FIG. 3 and only as regards the part corresponding to the actuation of the cylinder 8, i.e., the part designed for rotating the stretch 5 with respect to the stretch 4*b*, the other cylinders being actuated in a basically similar manner.

Figure 3:
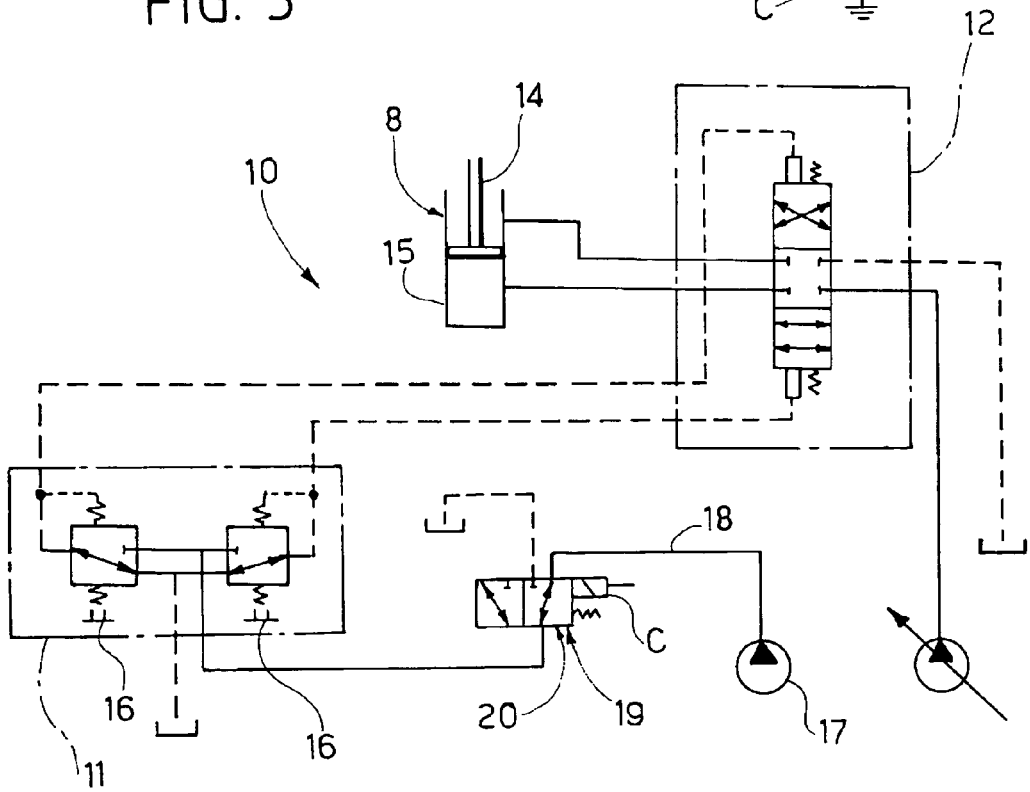

With reference to FIG. 3, the circuit 10 comprises a pilot valve 11 and a main valve 12 for continuous positioning, which is controlled by the valve 11 itself for control of the flow of oil from and to the cylinder 8. The pilot valve 11 is in turn controlled by the driver of the vehicle, in a known way (not described herein in detail), by means of manual-control members 16 set in the cab of the vehicle 1, to cause the rod 14 to be retracted or to come out with respect to the liner 15 of the cylinder 8.

The oil that performs the function of driving the valve 12 is supplied to the valve 11 by a pump 17 and through a pipe 18, along which there is set a bistable control solenoid valve 19. The solenoid valve 19 is controlled by a corresponding solenoid C for selectively switching between a disabling position, in which supply of oil to the valve 11 is blocked so as to inhibit driving of the valve 12 and hence actuation of the cylinder 8 by the driver, and an enabling position, in which it allows oil to flow to the valve 11 so as to enable driving of the valve 12 and hence actuation of the cylinder 8. According to an alternative variation, the solenoid valve 19 is set on a pipe in which there flows oil that supplies all the pilot valves of the circuit 10, and not only the valve 11, so as to inhibit/enable actuation of all the cylinders associated with displacement of the arm 3 and of the member 6, and not only actuation of the cylinder 8.

The solenoid valve 19 forms part of a device 20 for automatic configuration of the profile, which enables setting of the stretches 4*b* and 5 in a predetermined relative reference position such as to satisfy parameters of maximum encumbrance of the vehicle 1 laid down in the highway code and hence to enable circulation of the vehicle 1 on the road.

Figure 2:
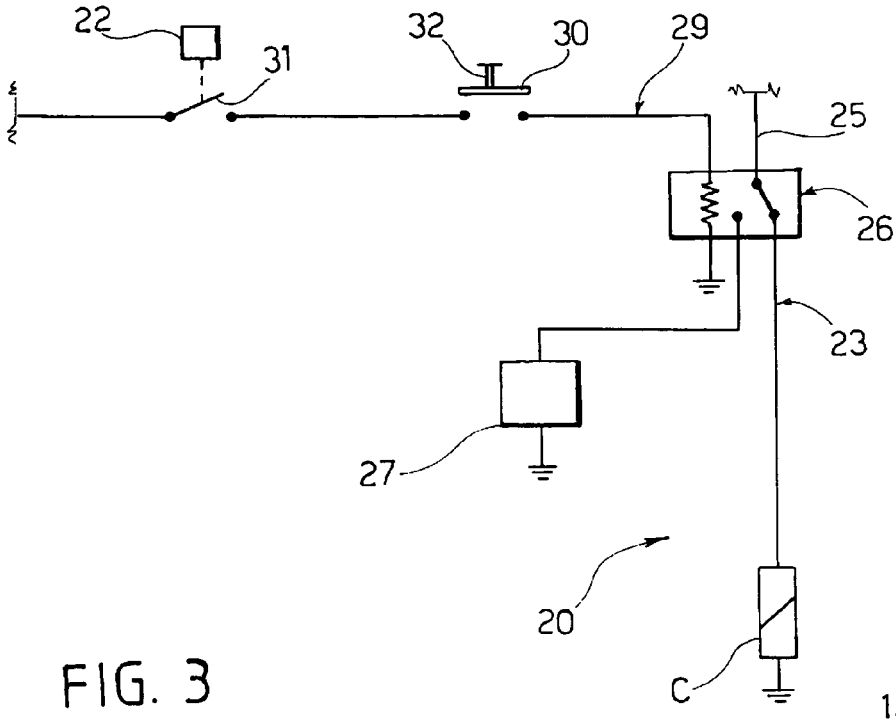
FIGS. 2 and 3 are two partial diagrams, one electrical and the other hydraulic, of the vehicle of FIG. 1.

With reference to FIG. 2, the device 20 comprises a position sensor 22 (illustrated schematically), preferably a proximity sensor, which is associated with the arm 3 for detecting when the aforesaid predetermined relative reference position is reached between the stretches 4*b* and 5, and accordingly issue a corresponding position signal or enable signal.

The device 20 further comprises an electrical circuit 23 (schematically illustrated), which in turn comprises a supply line 25 and a relay 26 set between the line 25 and the solenoid C. The relay 26 may be switched between a first operating position, in which the line 25 supplies electric current to the solenoid C for energizing the solenoid C itself and maintaining the solenoid valve 19 in its enabling position, and a second operating position, in which the line 25 supplies electric current to an acoustic signaling device 27, or buzzer, preferably of a timed type, whilst the solenoid C is not energized to switch the solenoid valve 19 to its disabling position.

The circuit 23 further comprises an excitation line 29, which is provided with two switches 30, 31 set in series with respect to one another and supplies electric current for energizing and switching the relay 26 from the first operating position to the second operating position when the switches 30, 31 are simultaneously closed. The switch 30 may be switched manually by the driver of the vehicle by means of a corresponding push-button or lever 32 (partially illustrated) located in the cab, whilst the switch 31 is normally open and is switched automatically according to the position signal issued by the sensor 22 in such a way as to close the circuit automatically when the stretches 4*b* and 5 reach the aforesaid predetermined relative reference position.

When the vehicle 1 has to circulate on the road, the arm 3 must be set in a position such as to respect the parameters of profile and maximum encumbrance laid down by the highway code (FIG. 1). In order to obtain this result, the driver first operates the cylinders 7*a*, 7*b* and 9 to bring them into respective pre-defined end-of-travel positions and then acts on the device 20 in order to position the rod 14 with respect to the liner 15 in an intermediate position corresponding to the aforesaid predetermined relative reference position between the stretches 4*b* and 5.

In particular, the driver of the vehicle first closes the switch 30 manually to activate the circuit 23 and render the device 20 operative, and then controls the members 16 for actuating the cylinder 8. When the stretches 4*b* and 5 reach their predetermined relative reference position during actuation of the cylinder 8, the sensor 22 issues a corresponding position signal that causes switching of the switch 31 to close the line 29 and hence switch the relay 26 to its second operating position. At this point, supply ceases to the solenoid valve 19, which switches to its disabling position, inhibiting the valve 11 to prevent further actuation of the cylinder 8, whilst the buzzer 27 starts to go off, indicating to the driver that the cylinder 8 is arrested in the desired intermediate position and that it can no longer be actuated by the members 16.

To render positioning of the cylinders 7*a*, 7*b*, 8, 9 and thus of the arm 3 secure, the driver gets down from by the vehicle 1 to close manually a plurality of cocks (not illustrated) associated to the chambers of the cylinders 7*a*, 7*b*, 8, 9 to prevent any leakage of oil from the circuit 10. As an alternative to at least part of the aforesaid cocks, in some solutions of excavating vehicles there are provided, on the chambers of each cylinder, respective safety valves, which are closed automatically by the absence of driving pressure in the circuit 10.

To restore the possibility of actuating the cylinder 8 again by means of the members 16, the driver must switch the switch 30 so that it opens the circuit. In fact, once the line 29 is opened by this manual command, the relay 26 switches to its first operating position, so that the line 25 no longer supplies the branch in which the buzzer 27 is present, but the branch in which the solenoid C is present, so causing switching of the solenoid valve 19 to its enabling position to render the valve 11 and hence the members 16 once again operative.

Finally, from the foregoing it emerges clearly how the device 20 makes it possible to set the arm 3, and in particular the stretches 4*b* and 5, in a pre-determined reference position in a precise and practically automatic way, i.e., without the driver having to assess visually the displacement of the arm 3, in so far as the solenoid valve 19 switches automatically to its disabling position when the sensor 22 detects that the aforesaid reference position has been reached. In addition, when the arm 3 has been positioned in the reference position, the device 20 prevents any further undesirable actuation of the cylinder 8, which may be due, for example, to accidental maneuvers on the members 16, in so far as it inhibits the valve 11 and hence driving of the valve 12 up to the moment in which the driver re-enables the possibility of actuating the cylinder 8 manually by opening the switch 30.

The device 20 is simple, in so far as it only requires the use of a simple solenoid valve 19, and not the use of possible complex mechanical or magnetic arrest or control equipment for arresting the cylinder 8 in the desired position or for inhibiting actuation of the cylinder 8 itself.

Finally, from the foregoing it emerges clearly that modifications and variations can be made to the device 20 described herein with reference to the attached figures, without thereby departing from the scope of protection of the present invention.

In particular, there could be provided means for disabling or arresting the cylinder 8 that are different from the solenoid valve 19 and the circuit 23 described and schematically illustrated herein by way of example.

In addition, the sensor 22 could be different from the one indicated; for instance, it could be an angular sensor of a continuous type and/or could be associated to the cylinder 8 for detecting the relative position between the rod 14 and the liner 15, instead of detecting the relative position of the stretches 4*b* and 5 directly.

Finally, the acoustic-signaling device 27 could be replaced by a luminous signaling device.

The invention claimed is:

1. An earth-moving vehicle comprising:

a mobile operating arm;

at least one actuator for moving the operating arm through a plurality of positions, wherein one of the plurality of positions is a pre-defined reference position;

a control for actuating the actuator; and a configuration device comprising a sensor designed for detecting at least the pre-defined reference position of the operating arm and for issuing a corresponding position signal, a disabling valve activated automatically according to the position signal to disable actuation of the actuator when the operating arm reaches the predetermined reference position, a re-enabling switch which can be switched manually by an operator for deactivating the disabling valve to enable the actuator to be actuated, and an activation switch which can be switched manually by the operator to render operative the configuration device wherein the disabling valve comprises a bistable device, switchable between an enabling position, in which it enables the control to control actuation of the actuator, and a disabling position, in which it inhibits the control from controlling actuation of he actuator.

2. The vehicle according to claim 1, wherein the actuator forms part of a hydraulic circuit controlled by the control; the bistable device forming part of the hydraulic circuit.

3. The vehicle according to claim 2, wherein the disabling valve is set along a pipe associated with actuation of a single actuator.

4. The vehicle according to claim 3, wherein the hydraulic circuit comprises a main valve for actuation of the actuator and a pilot valve, the pilot valve controlled directly by the control; the disabling valve being set on a pipe for supply of fluid to the pilot valve.

5. The vehicle according to claim 4, wherein the disabling valve is a solenoid valve; the configuration device comprises an electrical control circuit, which includes a first switch automatically switchable between a position of opening and a position of closing according to the position signal.

6. The vehicle according to claim 5, wherein the electrical control circuit comprises a supply line, a relay set between the solenoid valve and the supply line, and an excitation line, designed to switch the relay between a first operating position, in which the supply line supplies electric current to the solenoid valve, and a second operating position, in which the solenoid valve is isolated from the supply line; the first switch being set along the excitation line.

7. The vehicle according to claim 6, wherein the re-enabling switch comprises a second switch, which may be switched manually and is set in series to the first switch along the excitation line.

8. The vehicle according to claim 7, wherein the electrical control circuit comprises a signaling device supplied by the supply line when the relay is set in the second operating position.

9. The vehicle according to claim 2, wherein the disabling valve is set along a pipe associated with actuation of a plurality of actuators for moving the operating arm.

10. A work vehicle comprising:

an operating arm comprising a terminal stretch and an intermediate stretch and a hydraulic actuator for effecting relative movement between the terminal stretch and the intermediate stretch;

a main valve hydraulically coupled to the actuator for controlling fluid flow to the actuator;

a pilot valve hydraulically coupled to the main valve, wherein the pilot valve is manipulated by an operator and controls fluid flow to the main valve;

a solenoid valve hydraulically coupled to the pilot valve, a reservoir and a pump, the solenoid valve being actuatable to one of a first position and a second position, the first position coupling the pilot valve to the reservoir and the second position coupling the pilot valve to the pump; and an electrical circuit coupled to the solenoid valve, the electrical circuit comprising a relay, a manual switch actuatable by the operator and a position-sensor switch, the relay and manual switch being disposed in series, wherein the position-sensor switch is closed when a pre-defined position of the operating arm is sensed by a position sensor, which is electrically coupled to the position-sensor switch, wherein the relay actuates the solenoid valve to the first position when the manual switch is actuated by the operator and the position-sensor switch is closed.

* * * * *